US007712540B2

(12) United States Patent
Loretz et al.

(10) Patent No.: US 7,712,540 B2
(45) **Date of Patent: *May 11, 2010**

(54) FLOW CONTROL DEVICE

(75) Inventors: Ives D. Loretz, Houston, TX (US); Pierre Hosatte, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/237,818

(22) Filed: Sep. 25, 2008

(65) Prior Publication Data

US 2009/0020292 A1 Jan. 22, 2009

Related U.S. Application Data

(63) Continuation of application No. 11/307,079, filed on Jan. 23, 2006, now Pat. No. 7,455,115.

(51) Int. Cl.

| | |
|---|---|
| ***E21B 34/06*** | (2006.01) |
| ***G05D 7/00*** | (2006.01) |
| ***F16K 47/04*** | (2006.01) |

(52) U.S. Cl. ..... 166/373; 166/316; 166/334.1; 138/43; 251/127

(58) Field of Classification Search ..... 251/125–127, 251/118; 137/625.28, 625.3; 138/40, 43; 166/316, 332.1, 334.1, 373

See application file for complete search history.

(56) References Cited

U.S. PATENT DOCUMENTS

| | | | | |
|---|---|---|---|---|
| 3,595,315 A * | 7/1971 | Alley | 166/326 |
| 4,634,095 A * | 1/1987 | Taylor | 251/121 |
| 5,415,202 A * | 5/1995 | Shiffler et al. | 137/625.3 |
| 6,250,806 B1 * | 6/2001 | Beshoory | 384/97 |

* cited by examiner

*Primary Examiner*—Kenneth Thompson
(74) *Attorney, Agent, or Firm*—Rodney V. Warfford; Daryl R. Wright; Trop Pruner & Hu PC

(57) ABSTRACT

A choke that is usable with a well includes an inlet port and an outlet port. The choke also includes pressure drop stages between the inlet port and the outlet port. Each of the pressure drop stages is adapted to create part of an overall pressure differential between the inlet and outlet ports.

6 Claims, 7 Drawing Sheets

FLOW CONTROL DEVICE

RELATED APPLICATIONS

This application is a continuation of U.S. application Ser. No. 11/307,079, filed Jan. 23, 2006, the contents of which are herein incorporated by reference.

BACKGROUND

1. Field of the Invention

The invention generally relates to a flow control device, and more particularly, the invention generally relates to a flow control device for use in a well.

2. Description of the Related Art

The following descriptions and examples are not admitted to be prior art by virtue of their inclusion in this section.

A choke is a device that is typically used in a well for purposes of controlling a flow. For example, the choke may be used for purposes of regulating a rate of production flow from a particular zone of the well, or alternatively, the choke may be used for purposes of regulating the rate at which a particular fluid is injected into the well.

Due to the restriction of flow by the choke, the choke typically has to operate under a high differential pressure, i.e., the difference in pressure between the choke's inlet and outlet flows. A potential challenge with a high differential pressure is that flow limiting surfaces of the choke may erode.

Thus, there exists a continuing need for better ways to control a fluid flow in a well.

SUMMARY

In an embodiment of the invention, a choke that is usable with a well includes an inlet port and an outlet port. The choke also includes pressure drop stages between the inlet and outlet ports. Each of the pressure drop stages is adapted to create part of an overall pressure differential between the inlet and outlet ports.

In another embodiment of the invention, a system that is usable with a well includes a string and a flow control device. The string communicates fluid between a position that is downhole in the well and the surface of the well. The flow control device regulates a flow of the fluid and includes an inlet port, an outlet port and pressure drop stages between the inlet and outlet ports. Each of the pressure drop stages is adapted to create part of an overall pressure differential between the inlet and outlet ports.

In yet another embodiment of the invention, a technique that is usable with a well includes forming flow control stages between inlet and outlet ports of a downhole flow control tool. The technique includes distributing an overall pressure differential between the inlet and outlet ports among the flow control stages.

Advantages and other features of the invention will become apparent from the following drawing, description and claims.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

As used here, the terms "up" and "down"; "upper" and "lower"; "upwardly" and "downwardly"; "below" and "above"; and other similar terms indicating relative positions above or below a given point or element may be used in connection with some implementations of various technologies described herein. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

In the following description, numerous details are set forth to provide an understanding of the present invention. However, it will be understood by those skilled in the art that the present invention may be practiced without these details and that numerous variations or modifications from the described embodiments are possible.

Figure 1:
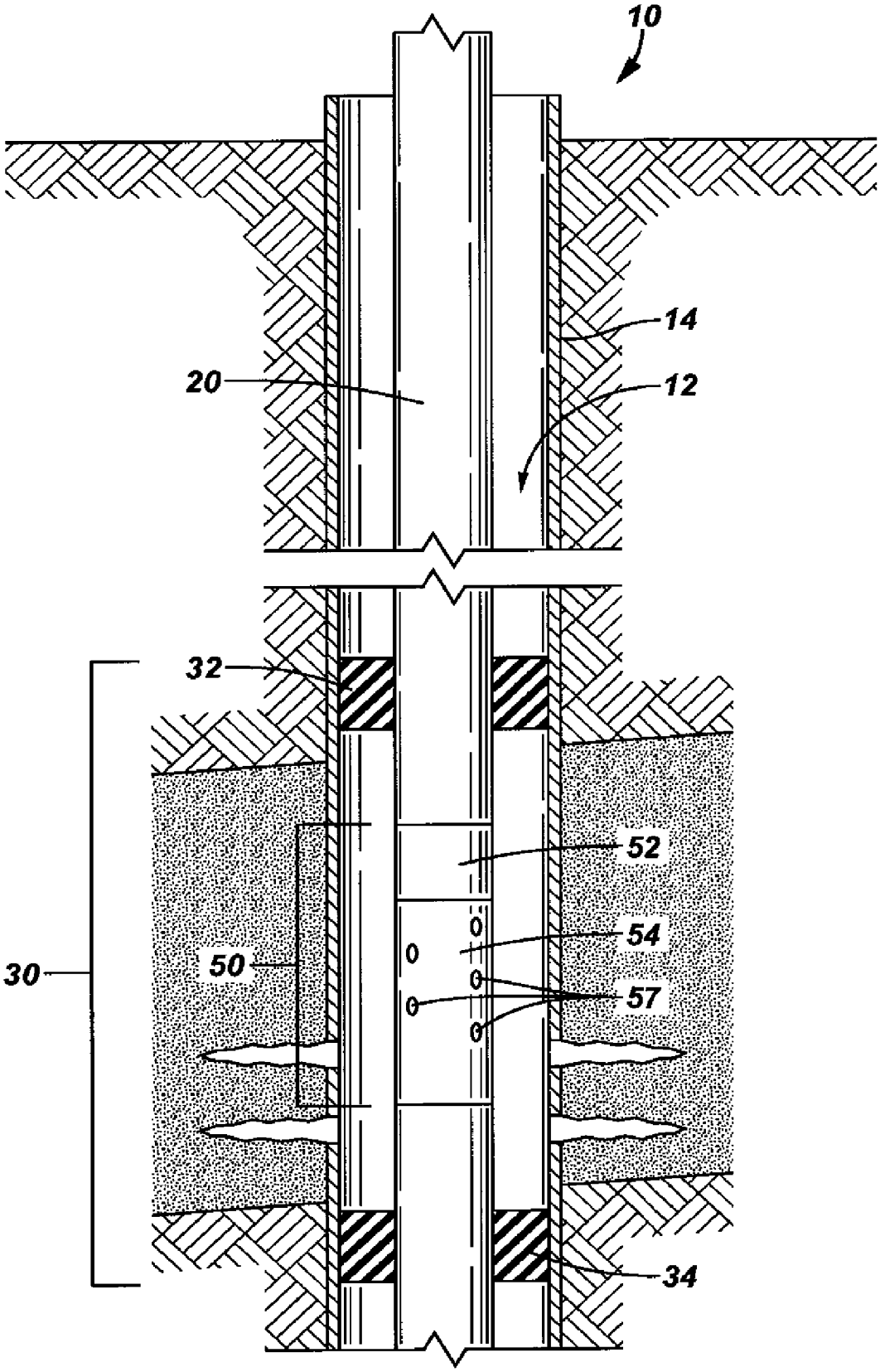
FIG. 1 is a schematic diagram of a well according to an embodiment of the invention.

Referring to FIG. 1, an embodiment 10 of a well in accordance with an embodiment of the invention includes a string 20 that extends into a wellbore 12. The wellbore 12 may be cased with a casing string 14, in accordance with some embodiments of the invention. However, the wellbore 12 may be uncased in accordance with other embodiments of the invention. Additionally, the well 10 may be a subterranean or subsea well, depending on the particular embodiment of the invention.

The string 20 may be a production string in accordance with some embodiments of the invention, and the string 20 may include a choke, or flow control device 50, which is positioned inside a particular production zone 30 of the well 10 for purposes of regulating the rate at which production fluid flows from the zone 30 into the central passageway of the string 20. The production zone 30 may be formed via upper 32 and lower 34 packers (for example) that seal off the annulus between the interior of the well casing 14 and the exterior of the string 20 above and below the production zone 30.

In accordance with some embodiments of the invention, the flow control device 50 includes a flow control section 54, which includes radial ports 57 for purposes of receiving well fluid into the central passageway of the production string 20 when the flow control device 50 is open. The rate at which the fluid flows into the central passageway is a function of the effective cross-sectional flow area that is presented by the flow control section 50.

More specifically, in accordance with some embodiments of the invention, the flow control section 54 includes an internal choke sleeve (not shown in FIG. 1), which is moved up and down along the longitudinal axis of the flow control device 50 by an actuator 52 of the flow control device 50. The actuator 52, in turn, may be remotely controlled from the surface of the well 10 or, alternatively, may be automatically controlled downhole in response to certain states of the production zone 30.

As further described below, the internal choke sleeve regulates the flow rate through multiple flow control stages of the flow control section 54. Each flow control stage drops part (the same pressure drop, for example) of the overall pressure difference between the central passageway of the string 20 and the annulus of the well, which surrounds the production string 20 near the flow control device 50. Due to this design, local velocities and erosion rates are considerably reduced throughout the flow control section 54, as compared to a conventional choke.

Figure 2:
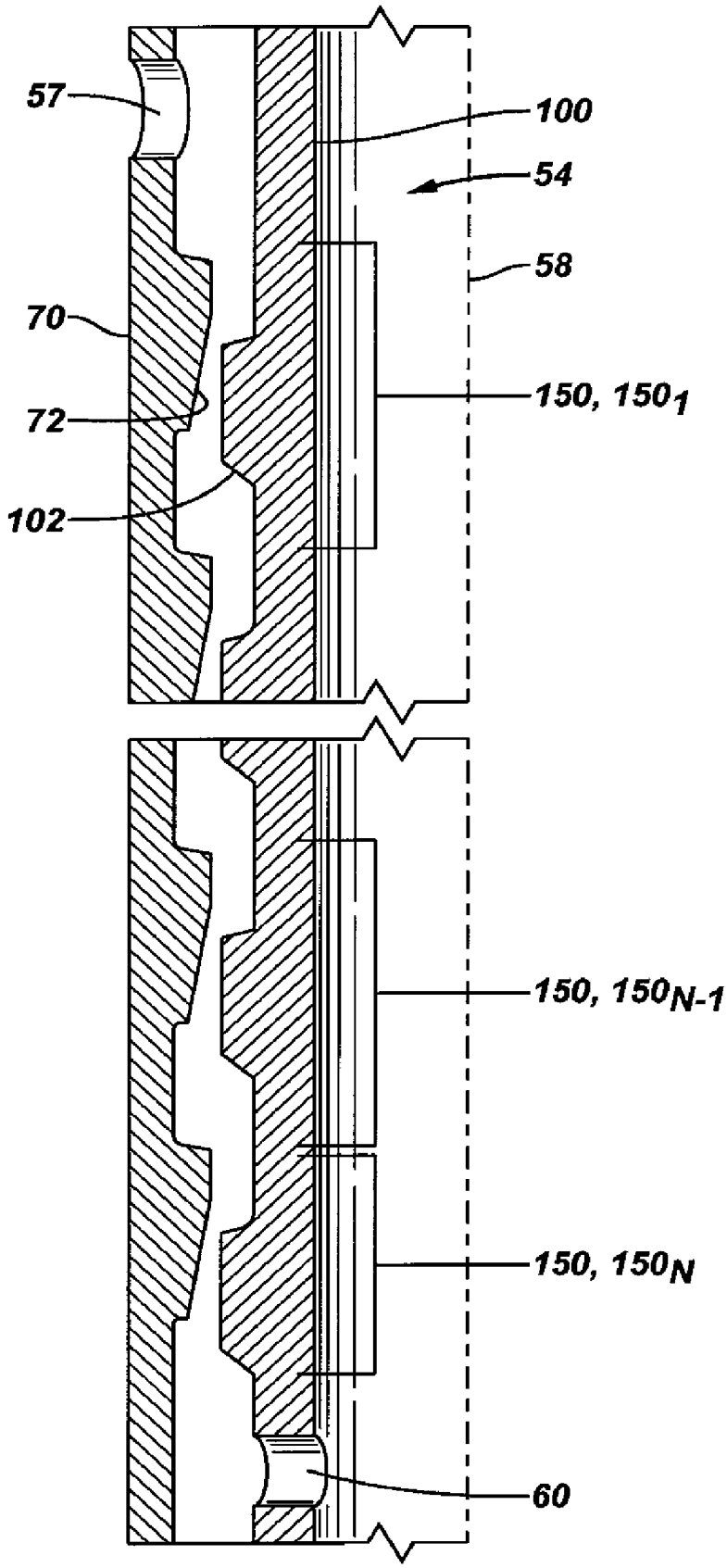
FIG. 2 is a schematic diagram depicting a flow control section of the flow control device of FIG. 1 when open according to an embodiment of the invention.

FIG. 2, which depicts an exemplary embodiment of the flow control section 54 when open, depicts the left half of the flow control section 54 about a longitudinal axis 58 of the section 54. Although the right half of the flow control section 54 is not shown, the flow control section 54 is symmetrical about the longitudinal axis 58.

The flow control section 54 is formed from an internal choke sleeve 100 that is concentric with the longitudinal axis 58. The internal choke sleeve 100 includes an outer surface 102 that has certain features (described further below) that cooperate with corresponding features of an inner surface 72 of a housing 70 of the flow control section 54. As depicted in FIG. 2, the housing 70 generally circumscribes the choke sleeve 100.

The well fluid enters the flow control section 54 through the radial ports 57 (one port 57 being depicted in FIG. 2); flows between the annular space that exists between the housing 70 and the choke sleeve 100; and exits the flow control section 54 through radial ports 60 (one port 60 being depicted in FIG. 2) that are formed in the choke sleeve 100 and are in communication with the central passageway of the string 20. The actuator 52 (FIG. 1) of the flow control device 50 controls the longitudinal position of the choke sleeve 100 relative to the housing 70, as the relative positions between the surfaces 72 and 102 control the effective cross-sectional flow area between the radial ports 57 and 60.

For the position of the choke sleeve 100, that is depicted in FIG. 2, the flow control section 54 is open to flow in that a continuous annular space is formed between the inlet 57 and outlet 60 ports. By moving the choke sleeve 100 in a downward direction, the effective cross-sectional flow area between the surfaces 72 and 102 is increased and thus, the flow rate through the flow control section 54 is increased. Conversely, by moving the choke sleeve 100 in an upward direction from the position depicted in FIG. 2, the effective cross-sectional flow area is restricted, thereby decreasing the flow rate.

In accordance with embodiments of the invention described herein, the inner surface 72 of the housing 70 defines N flow control stages 150 (stages 150.sub.1 . . . 150.sub.N−1 and 150.sub.N being depicted as examples), which are present along the fluid flow path from the inlet port 57 to the outlet port 60. Each of the stages 150 drops a portion of the overall pressure difference between the inlet 57 and outlet 70 ports. The overall flow rate between the inlet 57 and outlet 60 ports is a function of the position of the choke sleeve 100 relative to the housing 70.

In some embodiments of the invention, the flow control stages 150 may be constructed to experience identical pressure drops. More specifically, for the case in which the flow control section 54 includes N stages 150 that drop the same pressure, each stage 150 experiences the following pressure drop (assuming that each stage 150 is identical):

$$P.\text{sub.STAGE}=.\text{DELTA}.P/N \qquad \text{Equation 1}$$

wherein "P.sub.STAGE" represents the pressure drop across the stage 150; ".DELTA.P" represents the total pressure drop across the flow control section 54; and "N" represents the number of stages 50. Thus, each flow control stage 150 experiences a fraction (1/N) of the total pressure differential across the flow control section 54.

Figure 3:
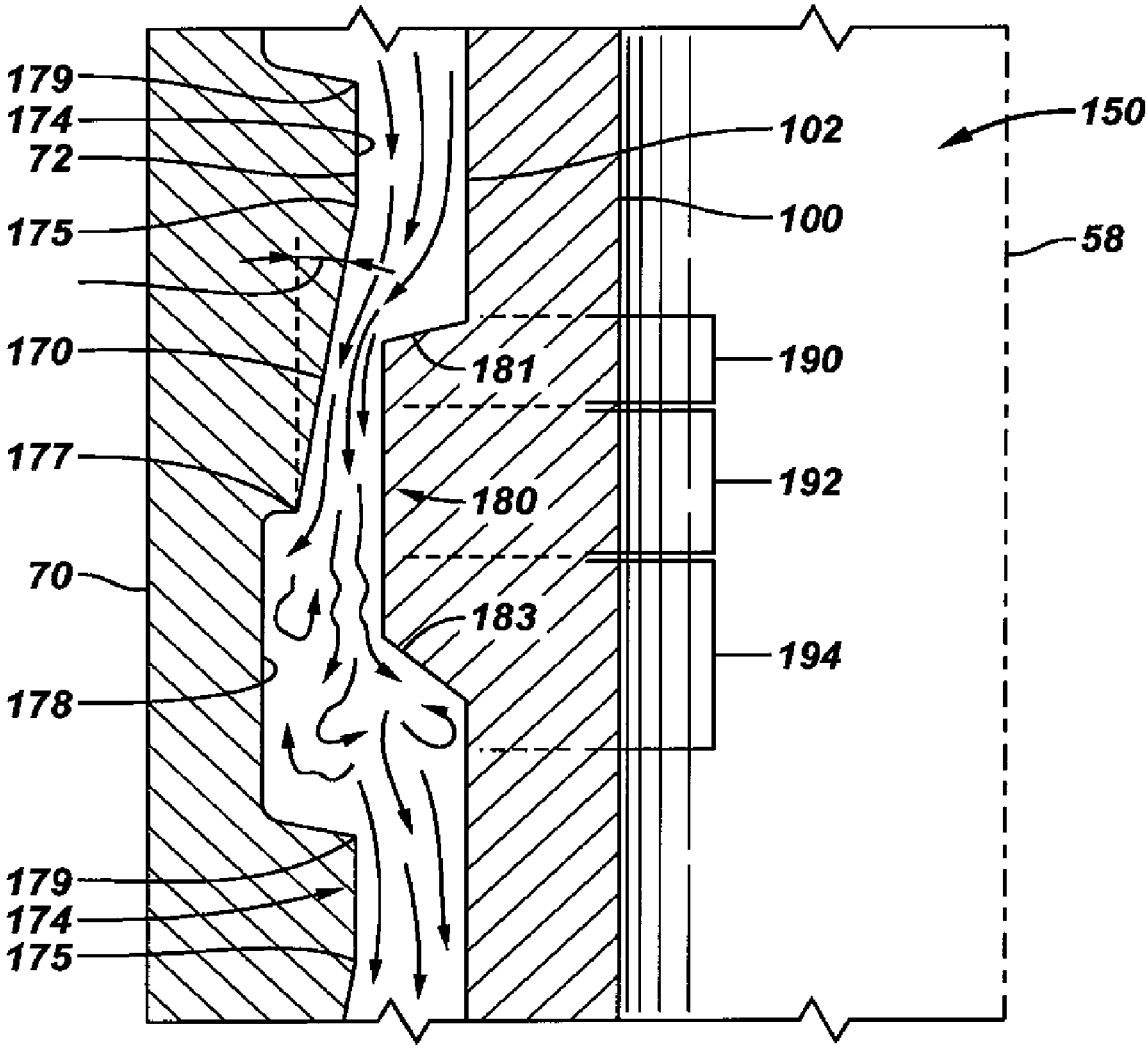
FIG. 3 illustrates a flow control stage of the flow control section of FIG. 2 according to an embodiment of the invention.

Referring to FIG. 3, as a more specific example, each flow control stage 150 may form three basic sections in accordance with some embodiments of the invention: a flow restriction section 190; a diffuser section 192; and a mixing section 194. The flow restriction section 190 establishes the flow rate through the stage 150 and produces a jet that is diffused by the diffuser section 192. The mixing section 194 breaks down the jet and aims at re-establishing a regular flow pattern across the cross-section of the flow area.

In accordance with some embodiments of the invention, for each flow control stage 150, the interior surface 72 of the housing 70 includes a beveled, or sloped, diffuser surface 170, which in combination with the radially opposing part of the outer surface 102 of the choke sleeve 100, defines the flow restriction 190 and diffuser 192 sections. The diffuser surface 170, in accordance with some embodiments of the invention, radially varies along the longitudinal axis 58 of the flow control stage 150 to create the sloped surface that is characterized by a diffuser angle (called ".theta." in FIG. 3).

More specifically, in accordance with some embodiments of the invention, the diffuser surface 170 is formed between annular surface transition edges 175 and 177. From the surface transition edge 175 to the surface transition edge 177, the radius of the surface 170 linearly increases to create the .theta. diffuser angle.

Across from the diffuser surface 170, the outer surface 102 of the choke sleeve 100 includes a protrusion 180, which has a relatively constant radius and resides between an annular upper shoulder 181 and an annular lower shoulder 183 of the surface 102. The flow restriction section 190 is formed by the region of the protrusion 180 near the upper shoulder 181 and the radially opposing portion of the diffuser surface 170. The diffuser section 192 is formed from the region of the protrusion 180 below the upper shoulder 181 and the radially opposing portion of the diffuser surface 170. Below the diffuser surface 170 the inner surface 72 of the housing 70 transitions at the edge 177 to form an annular groove 178, a surface feature that in conjunction with the radially opposing portion of the protrusion 180 forms the mixing section 194.

The annular groove 178 longitudinally extends from the edge 177 to an annular shoulder 179. At the annular shoulder 179, the inner surface 72 of the housing 70 has a reduced radius to form a radial protrusion 174. The radial protrusion 174 has a radius about the longitudinal axis 58, which is approximately the same as the radius of the radial protrusion 180 of the outer surface 102 of the choke sleeve 100. When the choke sleeve 100 is moved to the appropriate position so that the protrusions 174 and 180 are radially opposed, flow through the stage 150 is reduced to a minimum, which may mean no flow, in some embodiments of the invention.

In accordance with some embodiments of the invention, the radial protrusions 180 of the outer surface 102 of the choke sleeve 100 have the same spacing along the longitudinal axis 58 as the diffuser surfaces 170 of the inner surface 72 of the housing 70. Therefore, the stages 150 are identical and drop the same pressure in accordance with some embodiments of the invention. However, in other embodiments of the invention, the surfaces 72 and 102 may be configured to cause the stages 150 to differ and produce different pressure drops. Thus, many variations are possible and are within the scope of the appended claims.

Stages may also be designed to feature cuts or protrusions along the circumference of the flow channel. This may be used to further optimize flow and choking characteristics for certain applications, as described further below in connection with FIG. 7.

By moving the choke sleeve 100 in an upward longitudinal direction relative to the housing 70, flow through the flow restriction section 190 is further restricted, as the gap between the radial protrusion 180 and the diffuser surface 72 narrows. Eventually, when the protrusions 174 and 180 radially align, a minimum flow (no flow, for example) exists through the flow control stage 150. Conversely, by moving the choke sleeve 100 in a downward longitudinal direction relative to the housing 70, the flow is increased, as the gap between the radial protrusion 180 and the diffuser surface 72 increases.

Figure 4:
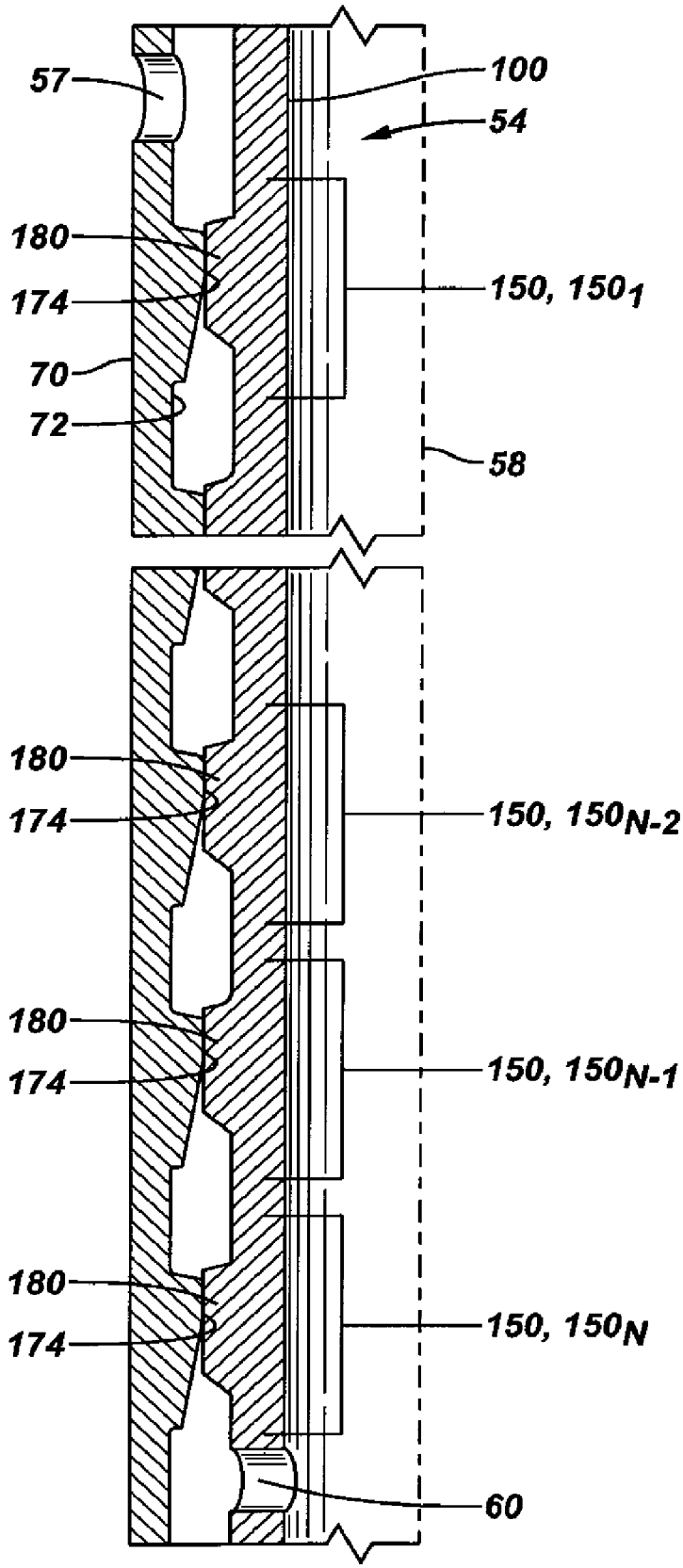
FIG. 4 is a schematic diagram of the flow control section when closed according to an embodiment of the invention.

FIG. 4 depicts the flow control section 54 for the case in which the protrusions 174 and 180 are aligned and the minimum flow (no flow, for example) exists through the flow control section 54. To completely shut off flow through the flow control section 54, fluid seals may be used either within the choking stages or external to them.

Figure 5:
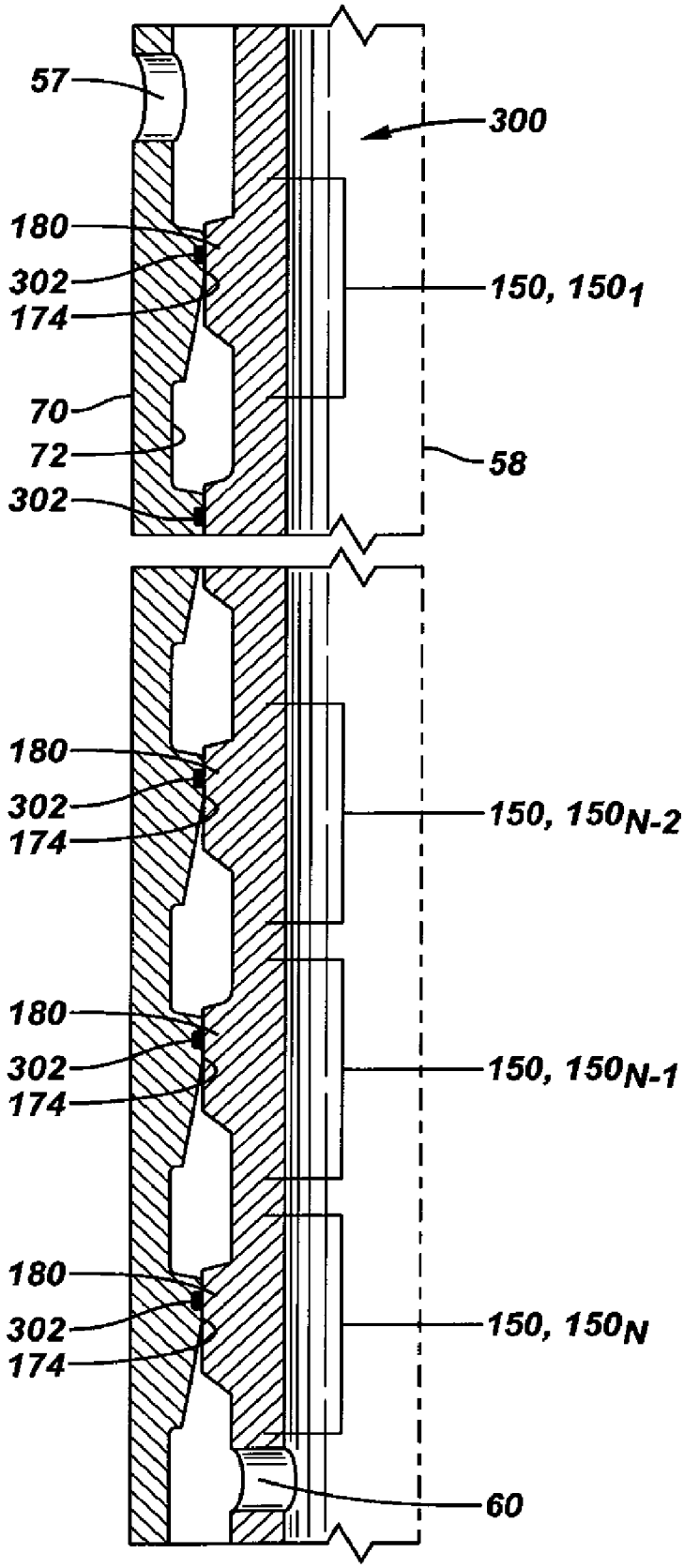
FIG. 5 is a schematic diagram of a flow control section when closed according to another embodiment of the invention.

For example, FIG. 5 depicts a flow control section 300 of a flow control device according to another embodiment of the invention. The flow control section 300 has a similar design to the flow control section 54, with the same reference numerals being used to depict similar elements. However, the flow control section 300, unlike the flow control section 54, includes radial seals 302 to form fluid seals between the radial protrusions 174 and 180 when aligned. As a more specific example, in accordance with some embodiments of the invention, the seals 302 (o-rings, for example) may be located in annular grooves, which are formed in the interior surface 72 of the housing 70. Other seals and scaling arrangements may be used in accordance with other embodiments of the invention.

For the embodiments of the flow control sections 54 and 300 that are discussed above, a unidirectional flow is assumed. In this regard, the discussion above assumes a flow from the inlet 57 to the outlet 60 ports, such as a flow that occurs in connection with fluid that is produced from the well. It is noted that flow may be communicated in an opposite direction in accordance with other embodiments of the invention. More particularly, in accordance with other embodiments of the invention, instead of the surface normals of the diffuser angles having downward components, the surface normals may have upward components, as fluid may flow from the ports 60 to the ports 57 for the case in which the flow control section is part of an injection choke in which fluids are injected into the well. Thus, many variations are possible and are within the scope of the appended claims.

Figure 6:
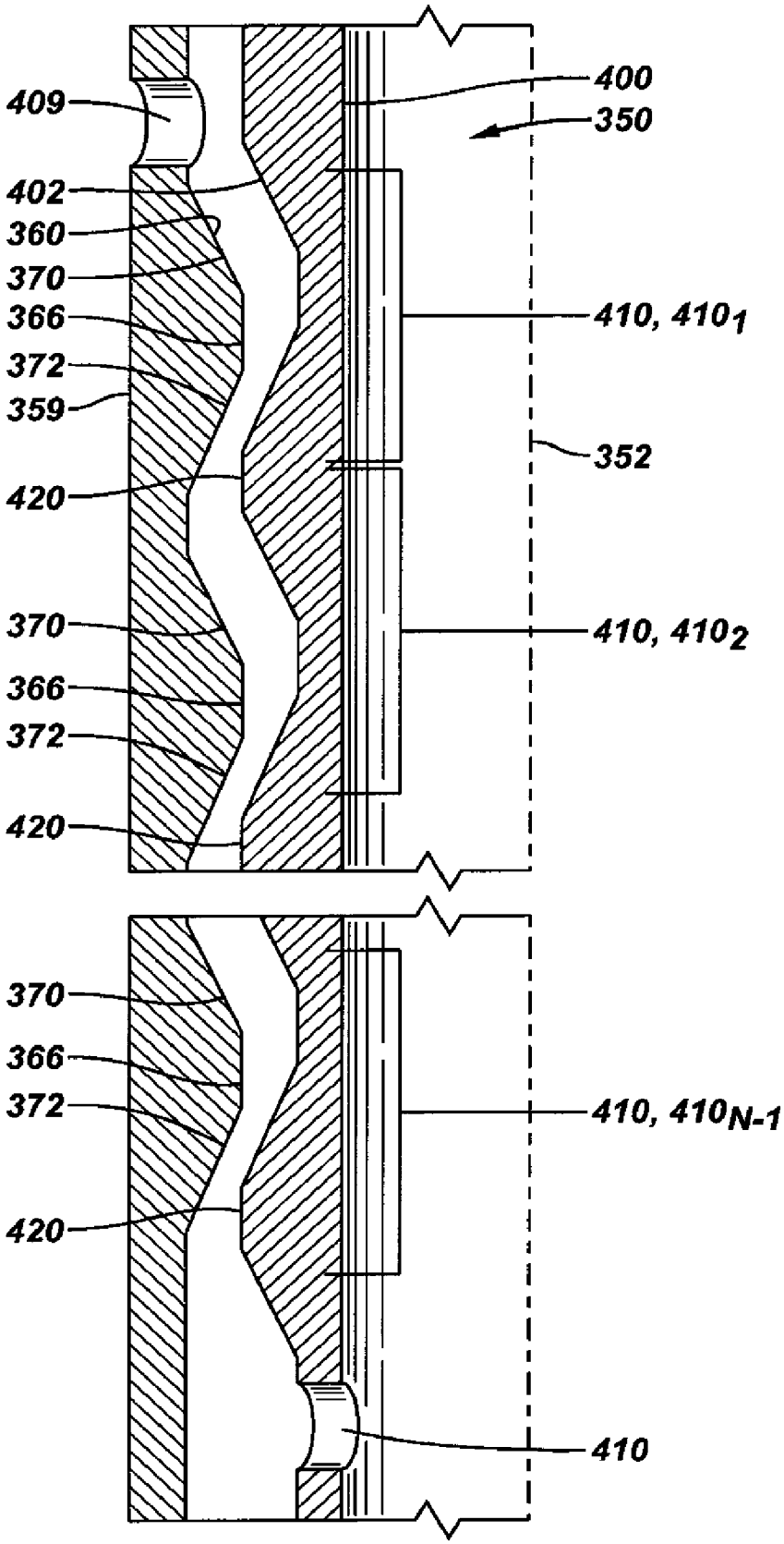
FIG. 6 is a schematic diagram of a flow control section when open according to another embodiment of the invention.

In accordance with other embodiments of the invention, a flow restriction section of a choke may be bidirectional in nature in that the flow may be in either longitudinal direction. As a more specific example, FIG. 6 depicts an exemplary flow control section 350 in accordance with some embodiments of the invention. As depicted in FIG. 6, the flow control section 350 includes a housing 359 that generally circumscribes an internal choke sleeve 400. The housing 359 includes radial ports 409 (one port 409 being depicted in FIG. 6) that is generally open to the well; and the choke sleeve 400 includes radial ports (one port 410 being depicted in FIG. 6) that is generally open to the central passageway of a string. As depicted in FIG. 6, the flow control section 350 generally circumscribes and may be symmetrical about a longitudinal axis 352 of the section 350; and thus, the symmetrical other half of the section 350 is not depicted in FIG. 6.

Unlike the flow control sections that are described above, the housing 359 includes an interior surface 360 that accommodates flow in either an upward direction or a downward direction. The surface 360 defines flow control stages 410 (flow control stages 410.sub.1, 410.sub.2 . . . 410.sub.N, being depicted as examples in FIG. 6) along the longitudinal axis 352. Each flow control stage 410 includes a beveled diffuser surface 370 (part of the surface 360) that has a surface normal with an upward component and a diffuser surface 372 (part of the surface 360) with a surface normal that has a downward component. A radial protrusion 366 of the surface 360 extends inwardly and separates the diffuser surfaces 370 and 372.

The choke sleeve 400 has an outer surface 402 that is generally complementary to the inner surface 360 of the housing 359. As can be seen in FIG. 6, movement of the choke sleeve 400 in an upward longitudinal direction relative to the housing 359, further restricts flow. Eventually, when the radial protrusions 366 of the surface 360 of the housing 359 align with corresponding radial protrusions 420 of the surface 402 of the choke sleeve 400, the flow is reduced to a minimum (no flow, for example). Conversely, by moving the choke sleeve 400 in a downward longitudinal direction relative to the housing 359, the flow is increased. Fluid seals may be located in annular grooves that are formed in the radial protrusions 366 for purposes of completely blocking off flow when the protrusions 306 and 420 align, in accordance with some embodiments of the invention.

In some embodiments of the invention, adjustment of flow rates may be achieved by translation and/or rotation of either the inner or outer sleeve.

In some embodiments of the invention, the flow control choke may be designed to accommodate injection and production flows while in operation. In such designs, the geometry of each stage may be symmetrical about a center plane that is perpendicular to the longitudinal axis of the choke. However, non-symmetric variations are equally envisioned under this invention and offer more flexibility to optimize performance for specific applications.

Figure 7:
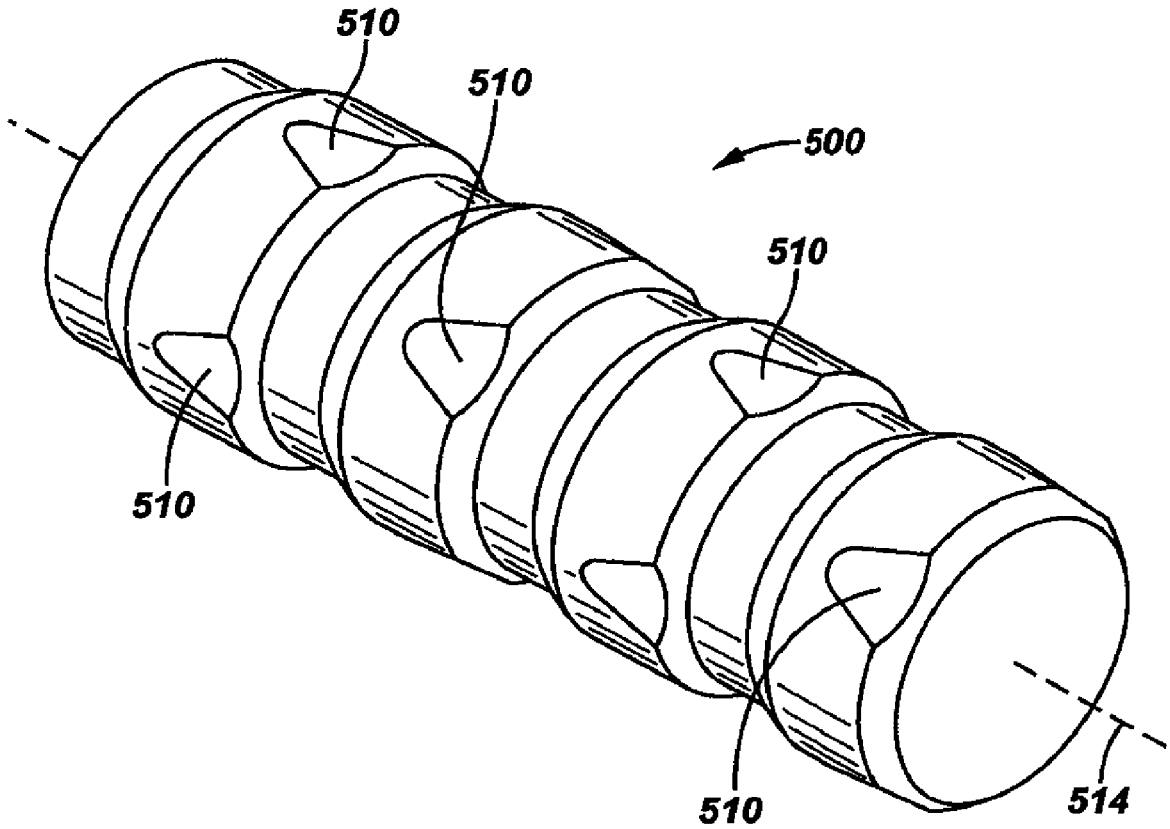
FIG. 7 is a perspective view of an internal choke sleeve according to another embodiment of the invention.

Referring to FIG. 7, as an example of another embodiment of the invention, an internal choke sleeve 500 (to replace any of the choke sleeves described herein) includes additional cuts 510 for purposes of further optimizing flow and choke characteristics. As depicted in FIG. 7, for a particular stage, the cuts 510 may be uniformly spaced in about a longitudinal axis 514 of the sleeves 500. Between stages, the cuts 510 of one stage may be rotated with respect to the cuts of another adjacent stage. Thus, many variations are possible and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A choke usable with a well, comprising:

an inlet port;

an outlet port;

pressure drop stages between the inlet port and the outlet port, each of the pressure drop stages being adapted to create part of an overall pressure differential between the inlet port and the outlet port, wherein at least one of the pressure drop stages comprises a first region to restrict flow between the inlet port and the outlet port and a second region to diffuse a jet produced by the first region;

a housing containing the inlet port and comprising a first surface; and a sleeve containing the outlet port and being at least partially surrounded by the housing, wherein the sleeve comprises a second surface, and the first surface and the second surface create the pressure drop stages.

2. The choke of claim 1, wherein each of the pressure drop stages is adapted to create approximately the same pressure drop.

3. The choke of claim 1, wherein said at least one of the pressure drop stages further comprises a third region to mix the jet.

4. The choke of claim 1, wherein the first region is adapted to restrict the flow between the inlet port and the outlet port and the second region is adapted to diffuse the jet produced by the first region regardless of whether the flow is in a direction from the inlet port to the outlet port or in a direction from the outlet port to the inlet port.

5. A system usable with a well, comprising:

a string to communicate fluid between a position downhole in the well and the surface of the well;

a flow control device to regulate a flow of the fluid, the flow control device comprising:

an inlet port;

an outlet port;

pressure drop stages between the inlet port and the outlet port, each of the pressure drop stages being adapted to create part of an overall pressure differential between the inlet port and the outlet port, wherein at least one of the pressure drop stages comprises a first region to restrict flow between the inlet port and the outlet port and a second region to diffuse a jet produced by the first region;

a housing containing the inlet port and comprising a first surface; and a sleeve containing the outlet port and being at least partially surrounded by the housing, wherein the sleeve comprises a second surface, and the first surface and the second surface create the pressure drop stages.

6. A method usable with a well, comprising:

forming flow control stages between an inlet port and an outlet port of a downhole flow control tool;

distributing an overall pressure differential between the inlet port and the outlet port among the flow control stages;

for at least one of the flow control stages, forming a first region to restrict flow between the inlet port and the outlet port and a second region to diffuse a jet produced by the first region;

for said at least one of the flow control stages, forming a third region to mix the jet; and regulating a flow through the flow control stages, the regulating comprising selectively positioning a sleeve with respect to a housing.

* * * * *